US005725911A

United States Patent [19]

Tsuneta et al.

[11] Patent Number: 5,725,911

[45] Date of Patent: Mar. 10, 1998

[54] METHOD FOR FORMING A METAL SPRAY COATING

[75] Inventors: Kazuyoshi Tsuneta; Kenji Hasui; Toru Taki, all of Nishinasuno-machi, Japan

[73] Assignee: Dai Nippon Toryo Co., Ltd., Osaka, Japan

[21] Appl. No.: 653,022

[22] Filed: May 24, 1996

[30] Foreign Application Priority Data

Jun. 22, 1995 [JP] Japan ..... 7-155936

[51] Int. Cl.[6] ..... B05D 1/02; B05D 1/36; B05D 1/08

[52] U.S. Cl. ..... 427/421; 427/407.1; 427/409; 427/449; 427/455

[58] Field of Search ..... 427/407.1, 421, 427/409, 449, 455

[56] References Cited

U.S. PATENT DOCUMENTS 4,578,310 3/1986 Hatfield ..... 428/334
4,883,703 11/1989 Riccio et al. .
4,971,838 11/1990 Hamamura et al. .
5,571,861 11/1996 Klein et al. ..... 524/591

FOREIGN PATENT DOCUMENTS 0 275 083 7/1988 European Pat. Off. .
0 541 085 5/1993 European Pat. Off. .
36 16 567 11/1987 Germany .

OTHER PUBLICATIONS

Database WPI, Derwent Publications, AN 93-112912, JP-A-05 051 559, Mar. 2, 1993.

*Primary Examiner*—Shrive Beck
*Assistant Examiner*—Bret Chen
*Attorney, Agent, or Firm*—Oblon, Spivak, McClelland, Maier & Neustadt, P.C.

[57] ABSTRACT

A method for forming a metal spray coating, which comprises coating on a substrate to be metal-sprayed, one pack type cold self-crosslinking resin aqueous dispersion containing insoluble solid particles having an average particle size of from 5 to 200 μm, to form a primer layer having a rough surface, and then spraying a metal on the primer layer.

10 Claims, No Drawings

METHOD FOR FORMING A METAL SPRAY COATING

The present invention relates to a method for forming a metal spray coating. More particularly, it relates to a method for forming a metal spray coating, wherein as a means to roughen the substrate surface to be metal-sprayed in order to improve the adhesion of the metal spray coating, a primer excellent in e.g. the corrosion resistance, heat resistance and solvent resistance, is coated for surface roughening without using conventional blast treatment.

For example, when steel is the substrate to be coated, it has been common to coat it with a metal less noble than iron, such as zinc or a zinc-aluminum alloy, by electroplating, hot dipping or spraying. By such methods, it is possible to protect iron by virtue of the sacrificial corrosion preventing effect of the coating metal less noble than the iron substrate. Because of this feature, such methods have been used for steel materials for building and construction, thin steel plates for automobiles, various electric casings or various industrial machine materials.

Among the above-mentioned methods, electroplating or hot dipping can not easily be conducted at any other places than the specified plants, because the size of the substrate is limited depending upon the size of the plating bath. Especially in the case of hot dipping, the substrate is dipped in a molten metal at a temperature as high as from 450° to 600° C., whereby a problem of thermal distortion is likely to result, and it is hardly applicable to thin steel plates. Thus, there have been various restrictions.

On the other hand, metal spraying has been used for bridges or steel structures since it has various merits such that no substantial dimensional distortion takes place since the substrate is not substantially heated, that the spray coating can be obtained in any desired thickness, that even a large substrate can be treated at the site, and that an organic coating material can readily adhere to the spray coating. It is expected that its application will still be expanded in the future.

However, when a metal is coated directly on a smooth surface of e.g. steel by metal spraying, the adhesion of the metal spray coating to the substrate is extremely poor because no affinity or chemical bond is obtained as between the substrate and the metal spray coating.

To overcome such a drawback, it has been common to subject the smooth surfaced substrate to blast treatment such as sand blasting or grit blasting to provide an anchoring effect between the substrate and the metal spray coating (e.g. U.S. Pat. No. 4,506,485).

However, a high level of skill is required for the operation of such a blast treatment as the pretreatment, and it takes a long period of time for the operation. Further, a substantial amount of dust produced by the blasting creates not only problems from the safety and hygiene aspects of the operation but also an environmental pollution problem. Therefore, a certain preventive treatment had to be taken, and thus such a process has been disadvantageous also from the aspect of the processing costs.

When a thin steel plate or plastic having a thickness of not more than about 1 mm is subjected to blast treatment, it frequently happens that a substantial distortion is created by the impact force of the blasting material, or in an extreme case, the substrate breaks.

Under the circumstances, it has been proposed to conduct metal spraying without applying such blast treatment.

For example, a method has been known wherein a primer containing insoluble solid particles is coated on a substrate to be metal-sprayed to form a primer layer having a roughened surface, and a metal is sprayed on this primer layer (U.S. Pat. No. 4,971,838). This method has attracted an attention as a method for solving the above problems inherent to blast treatment.

As such a primer, it is strongly desired to use an aqueous primer employing water or a solvent composed mainly of water, particularly a one pack type cold drying aqueous primer which can be applied at site and which is less problematic with respect to e.g. pot life, with a view to preventing air pollution, conservation of resources or preventing fire.

Such a one pack type cold drying aqueous primer is disclosed also in the above-mentioned U.S. Pat. No. 4,971,838. However, the disclosed primer is a non-crosslinkable aqueous primer and will not be crosslinked to form a network polymer structure when it is formed into a film. Accordingly, various coating properties such as corrosion resistance, heat resistance, solvent resistance and adhesion, are inadequate, and it frequently happens that the sacrificial corrosion preventing effect inherent to the metal spray coating can not adequately be obtained for a long period of time.

Accordingly, for example, when rust has not been completely removed from the substrate to be metal-sprayed, when the surface of the metal spray coating has been subjected to sealing treatment with a sealer containing an organic solvent, when metal-spraying has been applied at a high temperature, or when the substrate to be metal-sprayed, is placed outdoors under scorching sun lights or outdoors so that it will be exposed to e.g. rain water, the primer layer is likely to undergo deterioration, blistering or in some cases, peeling, whereby even if the metal spray coating is sound by itself, due to the defect in the primer layer, the metal spray coating may undergo blistering or peeling, so that no adequate long lasting sacrificial corrosion preventing effect can be obtained.

Therefore, commercially available practical useful primers are mostly organic solvent-base two pack type curable epoxy resin primers which are less likely to have the above-mentioned drawbacks.

It is an object of the present invention to provide a method for forming a metal spray coating, whereby the above-mentioned problems in the conventional methods for forming metal spray coatings can be overcome, i.e. whereby a long lasting sacrificial corrosion preventing effect can be obtained by a metal spray coating by using a primer coating method instead of a conventional blasting method as a means to roughen the surface of the substrate to be metal-sprayed and by using an aqueous primer which is capable of forming a primer layer excellent in the corrosion resistance, heat resistance, solvent resistance, etc. and which uses water as the solvent without using an organic solvent or without requiring no substantial amount of an organic solvent, for a primer.

The present inventors have conducted extensive researches to overcome the conventional problems and as a result, have found that by using a one pack type cold self crosslinking resin aqueous dispersion as a primer, a long lasting sacrificial corrosion preventing effect can be obtained, and this method is excellent in the safety, hygiene and environmental protection. The present invention has been accomplished on the basis of this discovery.

Thus, the present invention provides a method for forming a metal spray coating, which comprises coating on a substrate to be metal-sprayed, one pack type cold self-crosslinking resin aqueous dispersion containing insoluble solid particles having an average particle size of from 5 to 200 μm, to form a primer layer having a rough surface, and then spraying a metal on the primer layer.

Now, the present invention will be described in detail with reference to the preferred embodiments.

The substrate to be metal-sprayed (hereinafter referred to simply as a substrate) to be used in the method of the present invention includes iron materials such as tin plates, dull finish steel plates, cold rolled steel plates, black skin steel plates, surface-treated rusted steel plates, welded steel plates and castings; non-ferrous metals such as aluminum and zinc; plastics such as ABS, PPO and polyvinyl chloride; inorganic materials such as slates, calcium silicate plates and concrete structures; and various other substrates such as glass, wood, laminated plates and such substrates coated with coating materials.

The one pack type cold self-crosslinking resin aqueous dispersion to be coated on the substrate prior to metal spraying in the method of the present invention, comprises a binder which undergoes a crosslinking reaction during film-forming at room temperature to form a cured coating film as a network-structured polymer primer layer, insoluble solid particles to roughen the surface of the primer layer and, as a solvent, water or water having a small amount of an organic solvent incorporated as the case requires, and it may further contain various additives, such as a coloring pigment, an extender, a rust-preventing pigment or a modifying resin, which does not substantially contribute to the surface roughening, a thickener, a sedimentation-preventing agent, a temporary rust-preventing agent, a dispersant, a lubricant, a film-formation assisting agent, a curing accelerator, a defoamer and an anti-freezing agent, as the case requires.

As the above binder, any conventional binder may be employed, so long as such a binder will, upon evaporation of the solvent after coating, react to form a network structure thereby to form a cured coating film. However, in the present invention, the following binder is particularly suitable.

Namely, it is a mixture prepared by mixing a copolymer (A) containing carbonyl groups (other than carbonyl groups based on carboxyl groups or carboxylic acid ester groups; hereinafter referred to simply as carbonyl groups) and a hydrazone compound containing at least two hydrazone residues in its molecule in such a ratio that the hydrazone residues of the hydrazone compound (B) are from 0.1 to 2 equivalents per equivalent of the carbonyl groups of the copolymer (A). However, the two will undergo a dehydration condensation crosslinking reaction. Therefore, the copolymer (A) is mixed in the form of an aqueous dispersion with the compound (B). The two will immediately undergo the above reaction upon evaporation of water from a coating film formed by the coating operation.

As an aqueous dispersion of a copolymer (A) containing carbonyl groups, the one obtained by a conventional method as disclosed in e.g. Japanese Unexamined Patent Publication No. 51559/1993, such as an aqueous dispersion obtained by emulsion polymerization of a monomer mixture comprising a carbonyl group-containing unsaturated monomer and another copolymerizable unsaturated monomer, in water in the presence of an emulsifier, may be mentioned as a typical example. Particularly preferred in the present invention is an aqueous dispersion obtained by the following self emulsification, since it is excellent in the mechanical stability, the solvent mixing stability, the storage stability, etc., whereby even when insoluble solid particles are incorporated thereto, kneading can be done without using a dispersion assisting agent which is likely to deteriorate the water resistance.

Namely, an aqueous dispersion of a copolymer containing carbonyl groups as preferred component (A) is the one obtained by emulsion polymerizing a carbonyl group-containing unsaturated monomer, a carboxyl group-containing unsaturated monomer and other copolymerizable unsaturated monomer(s) in water in the presence of a small amount of an emulsifier to produce a copolymer having a weight average molecular weight of from about 10,000 to 300,000, then neutralizing the carboxyl groups with a basic compound as a neutralizing agent, and further incorporating a small amount of a hydrophilic solvent, as the case requires.

The above carbonyl group-containing unsaturated monomer may, for example, be diacetone acrylamide, acrolein, vinyl methyl ketone, vinyl ethyl ketone or diacetone (meth) acrylate.

The above carboxyl group-containing unsaturated monomer may, for example, be (meth)acrylic acid, itaconic acid, maleic acid or fumaric acid.

Said other copolymerizable unsaturated monomers include an alkyl (meth)acrylate such as methyl (meth) acrylate, ethyl (meth)acrylate, butyl (meth)acrylate or ethylhexyl (meth)acrylate; a hydroxyl group-containing unsaturated monomer such as hydroxyethyl (meth)acrylate, hydroxypropyl (meth)acrylate or hydroxybutyl (meth) acrylate; a glycidyl group-containing unsaturated monomer such as glycidyl (meth)acrylate; an amide group-containing unsaturated monomer such as N-methyl (meth)acrylamide, N-isobutyl (meth)acrylamide, N-methylol (meth) acrylamide, N-ethoxymethyl (meth)acrylamide or (meth) acrylamide; and other monomers such as styrene, (meth) acrylonitrile, vinyl acetate, vinyl chloride or ethylene.

The content of the above carbonyl group-containing unsaturated monomer is usually from 2 to 30 wt %, preferably from 3 to 20 wt %, in the total amount of the unsaturated monomers. If the amount of the carbonyl group-containing unsaturated monomer is less than the above range, the crosslinking density tends to be small, and the desired coating film properties tend to be hardly obtainable. On the other hand, if the amount is large, the water resistance or the like tends to deteriorate.

The content of the above carboxyl group-containing unsaturated monomer is usually from 0.3 to 10 wt %, preferably from 0.5 to 5 wt %, in the total amount of unsaturated monomers. If the amount of the carboxyl group-containing unsaturated monomer is less than the above range, the self emulsification effect tends to be inadequate, and the mechanical stability or the like tends to deteriorate. On the other hand, if the amount is large, the water resistance or the like tends to deteriorate.

The basic compound as a neutralizing agent may, for example, be ammonia, triethylamine, dimethylethanolamine, monoethanolamine, triethanolamine or morpholine. The amount of the neutralizing agent is usually within a range of from 0.3 to 1.5 times in equivalent to the carboxyl groups of the copolymer.

The hydrophilic solvent to be incorporated as the case requires may, for example, be methanol, ethanol, isopropanol, diethylene glycol monomethyl ether, diethylene glycol monoethyl ether, propylene glycol monomethyl ether, propylene glycol monoethyl ether, ethylene glycol monopropyl ether or ethylene glycol monobutyl ether. The amount of such a hydrophilic solvent is usually from 0 to 30 wt %, preferably from 5 to 25 wt %, of the above copolymer.

The aqueous dispersion of the copolymer (A) containing carbonyl groups, thus obtained, is preferably the one having a solid content of from 20 to 50 wt %, preferably from 30 to 45 wt %, with the rest being water.

To such an aqueous dispersion, a hydrazone compound as component (B) is incorporated to obtain an aqueous dispersion of the binder.

As the hydrazone compound, bisacetyldihydrazone is particularly preferred, since its solubility in water is small, and the reaction product thereof with a copolymer containing carbonyl groups will not be hydrolyzed, and even if incorporated in an excess amount, it will not reduce the water resistance.

The hydrazone compound is incorporated in such a amount that the hydrazone residues would be from 0.1 to 2 equivalents, preferably from 0.3 to 1.2 equivalents, per equivalent of the carbonyl groups of the copolymer (A). If the amount of the hydrazone compound is less than the above range, the crosslinking density tends to be small, and the desired coating film properties tend to hardly be obtained. On the other hand, if it exceeds the above range, no further improvement of the coating film properties can be obtained.

The hydrazone compound is preferably mixed in the form of a solution of about 20% as dissolved in a solvent such as methyl ethyl ketone, methyl isobutyl ketone or acetone, so that it is dispersed stably in the aqueous dispersion of the copolymer (A) containing carbonyl groups.

Another binder which may suitably be used in the present invention, is a mixture prepared by mixing the above copolymer (A) containing carbonyl groups and a hydrazine compound (B') containing at least two hydrazine residues in its molecule in such a ratio that the hydrazine residues of the hydrazine compound (B') are from 0.1 to 2 equivalents, per equivalent of the carbonyl groups of the copolymer (A). Also in this case, the two undergo a dehydration condensation crosslinking reaction. Therefore, the copolymer (A) is mixed in the form of an aqueous dispersion as mentioned above, with the compound (B') to obtain an aqueous dispersion of the binder.

The hydrazine compound may, for example, be oxalic acid dihydrazide, malonic acid dihydrazide, succinic acid dihydrazide, glutaric acid dihydrazide, adipic acid dihydrazide, sebacic acid dihydrazide, maleic acid dihydrazide, fumaric acid dihydrazide or itaconic acid dihydrazide.

The hydrazine compound is incorporated in such an amount that the hydrazine residues would be from 0.1 to 2 equivalents, preferably from 0.1 to 1.2 equivalents, per equivalent of the carbonyl groups of the copolymer (A). If the amount of the hydrazine compound is less than the above range, the crosslinking density tends to be small, and the desired coating film properties tend to be hardly obtainable. On the other hand, if it exceeds the above range, the water resistance tends to deteriorate.

In either the case wherein the hydrazone compound is used or the case wherein the hydrazine compound is used, such a compound undergoes a crosslinking reaction with the copolymer (A) containing carbonyl groups at room temperature upon evaporation of the solvent at the time of forming the coating film, to form a primer layer excellent in the corrosion resistance, heat resistance, solvent resistance, etc. However, in the case wherein the hydrazine compound is used, the reaction product with the copolymer containing carbonyl groups is hydrolyzable. Therefore, so long as the water resistance is concerned, it is preferred to employ the hydrazone compound.

The insoluble solid particles for roughening the surface of the primer layer, which are the essential constituting component of the one pack type cold self-crosslinking resin aqueous dispersion to be coated prior to metal spraying, are particles insoluble in a solvent, having an average particle size of from 5 to 200 μm, preferably from 30 to 100 μm. Such particles may, for example, be made of a metal such as copper, nickel, aluminum, zinc, iron or silicon, or an oxide, nitride, carbide or alloy thereof, or various plastic powders.

Particularly preferred is silica sand, aluminum or silicon carbide, since such a material is chemically stable and will not form a corroding cell with the metal constituting the metal spray coating.

If the particle size of the insoluble solid particles is less than the above range, it tends to be difficult to form a primer layer having the desired surface roughness which will be described hereinafter. On the other hand, if it is too large, they tend to sediment in the aqueous dispersion, and nozzle clogging is likely to result during the spray coating operation, whereby the coating efficiency will be poor. Further, it tends to be difficult to form a primer layer having the desired surface roughness which will be described hereinafter.

The insoluble solid particles are incorporated usually in an amount of from 25 to 400 vol %, preferably from 65 to 150 vol %, relative to the solid content of the above described binder.

If the insoluble solid particles are less than the above range, it tends to be difficult to form a primer layer having the desired surface roughness which will be described hereinafter, and if they are too much, the amount of the binder will be relatively small, whereby the physical and chemical strength of the primer layer will be low, such being undesirable.

The one pack type cold self-crosslinking resin aqueous dispersion for forming a primer layer in the present invention, comprises the constituting components as described above, and its solid content is usually from 30 to 90 wt %, preferably from 50 to 80 wt %.

On the other hand, as the metal material for forming the metal spray coating in the present invention, various metal materials which have been commonly used heretofore, may be optionally used depending upon the type of the substrate to be metal-sprayed. Specifically, zinc, aluminum, a zinc-aluminum alloy, a zinc-aluminum pseudo alloy, red brass, brass or cupro-nickel may, for example, be mentioned.

Now, a method for forming a metal spray coating according to the present invention will be described.

The surface of the substrate to be metal-sprayed is subjected to pretreatment such as degreasing treatment or treatment for removal of deposits such as rust or dust, as the case requires, and then the above-mentioned one pack type cold self-crosslinking resin aqueous dispersion is coated thereon by such a means as spray coating, brush coating or roll coating, if necessary, after adjusting the viscosity with a solvent.

The coating amount is usually within a range of from 10 to 300 g/m$^2$, preferably from 20 to 150 g/m$^2$. The surface of the primer layer thus formed is preferably a rough surface represented by a ratio of Sm/Rz being at most 5, where Sm is the average spacing of roughness peaks, and Rz is the ten point height of irregularity, and Rz being from 10 to 250 μm.

Here, the ten point height of irregularity (Rz) and the average spacing of roughness peaks (Sm) used in the present invention, are defined in JIS B-0601 and can readily be evaluated by a commercially available feeler-type surface roughness meter.

When metal spraying is conducted, metal particles (having a particle size of from a few μm to a few hundred μm) melted at a high temperature will fly towards the substrate at a high speed and collide against the substrate, whereupon they will be cooled and solidified.

In order to attain a high metal spraying efficiency in this instantaneous process and to obtain a metal coating having excellent adhesion, the surface roughened state of the substrate surface may not be too much or less as compared with the size of the molten metal particles. Accordingly, the substrate surface is required to have a proper surface roughness (the height of irregularities) and proper repetition of irregularities or a proper gradient of inclined surfaces.

To attain the maximum spraying efficiency and excellent adhesion in the operation for forming the metal spray coating of the present invention, the following conditions are preferred.

Firstly, the ten point height of irregularity (Rz) representing the irregularities of the rough surface in the present invention is required to be within a range of from 10 to 250 μm, preferably from 30 to 150 μm. If Rz is less than 10 μm, the irregularities are small, whereby the metal spraying efficiency tends to be substantially low, and the adhesion of the metal coating tends to be low. On the other hand, if Rz exceeds 250 μm, the surface tends to be too rough, whereby the surface finish tends to be poor, although the metal spray coating may be more readily adhered.

On the other hand, the frequency of repetition of the irregularities of the rough surface is also important. Namely, even if Rz is within the above range, if the distance between the irregularities is large, the effects as the rough surface tend to be low.

From such a viewpoint, in the present invention, the numerical value obtained by dividing the average spacing (Sm) of the irregularities by Rz, i.e. the ratio of Sm/Rz, is preferably at most 5, more preferably at most 3.

Thus, a rough surface having a proper surface roughness and irregularity distance, is obtained, whereby the metal spraying efficiency can be improved, and excellent adhesion can be attained.

The conditions for forming the rough surface having Rz and Sm/Rz required in the present invention, are complex and can not generally be defined. However, such a prescribed rough surface can be obtained by preliminarily setting the conditions for e.g. formulation of the above aqueous dispersion, the particle size of the insoluble solid particles, the viscosity of the aqueous dispersion and coating conditions.

In the present invention, a metal is sprayed on the primer layer having the specific surface roughness thus obtained.

The primer layer prior to the metal spraying may not necessarily be completely cured. Namely, the primer layer may be in a semi-cured state. Further, a method may be employed wherein the primer layer is dried and then a metal is sprayed thereon, followed by complete curing.

In the present invention, the metal spraying may be conducted by any spraying method such as a gas flame spraying method, an electric arc spraying method or a low temperature spraying method by means of a depressurized arc spraying machine. Particularly preferred is a low temperature spraying method, whereby metal spraying can be carried out at a relatively low temperature.

The low temperature spraying method comprises continuously melting a metal wire by electrical arc under a reduced pressure environment formed by means of a low temperature air stream jetted from around the arc point, and at the same time, the melted metal is aspirated to the front jet stream for pulverization and rapid cooling to a temperature around room temperature, whereby melted metal particles will be deposited in a super-cooled liquid state on the substrate. Accordingly, by this method, the spraying amount per unit time can be relatively increased, and it is possible to obtain a relatively thick spray coating.

The method for forming a metal spray coating of the present invention is as described in the foregoing. Further, it is also possible to coat a various sealing coating material such as a corrosion preventing coating material on the metal spray coating or apply a top coating to prevent penetration of water or to prevent wearing due to rusting of the metal spray coating.

According to the method of the present invention, a high level of blast treatment operation which is required by conventional methods to roughen the substrate surface to be metal-sprayed or to completely prevent rusting, not required, whereby environmental pollution due to dust, is little, and a coating having a rough surface similar to the rough surface formed by blast treatment can be formed by coating a one pack type cold self-crosslinking resin aqueous dispersion containing insoluble solid particles, whereby the operation efficiency is good. Further, the amount of the organic solvent used is little, whereby prevention of the air pollution or saving of the resources can be made possible. Furthermore, it is possible to form a primer layer excellent in the adhesion, corrosion resistance, heat resistance, solvent resistance, etc., whereby long lasting sacrificial corrosion prevention by the metal spray coating will be possible.

Now, the present invention will be described in further detail with reference to Examples. In the Examples, "parts" and "%" mean "parts by weight" and "% by weight", respectively, unless otherwise specified.

Preparation of aqueous dispersion A-1

Into a four-necked flask equipped with a stirrer, a heat exchanger, a thermometer and a dropping funnel, 146 parts of deionized water and 0.2 part of sodium dodecylbenzene sulfonate were charged and heated to 74° C. Then, 0.4 part of ammonium persulfate was further added thereto. While maintaining the mixture at 74° C., a mixture comprising 0.3 part of dodecylmercaptan and 100 parts of an unsaturated monomer mixture comprising 8 parts of diacetone acrylamide, 2 parts of methacrylic acid, 6 parts of 2-hydroxyethyl acrylate, 48 parts of methyl methacrylate and 36 parts of 2-ethylhexyl methacrylate, were dropwise added over a period of 3 hours with stirring to conduct emulsion polymerization. After completion of the dropwise addition, the mixture was heated to 86° C., then aged for 2 hours and cooled to 50° C. Then, 0.8 part of dimethylethanolamine and 0.8 part of triethylamine were added thereto with stirring for self emulsification. Further, 15 parts of ethylene glycol monobutyl ether was added to obtain aqueous dispersion A-1 having a solid content of 38% and a weight average molecular weight of 98,000.

Preparation of aqueous dispersions A-2 to A-4

Aqueous dispersions A-2 to A-4 were prepared in the same manner as for aqueous dispersion A-1 except that the components as identified in Table 1 were used.

TABLE 1

(unit: parts by weight)

| Aqueous dispersions | A-1 | A-2 | A-3 | A-4 |
|---|---|---|---|---|
| Water | 146 | 180 | 150 | 146 |
| Sodium dodecylbenzene sulfonate | 0.2 | 0.1 | 0.2 | 0.2 |
| Ammonium persulfate | 0.4 | 0.5 | — | 0.4 |
| Potassium persulfate | — | — | 0.4 | — |
| Diacetone acrylamide | 8 | 18 | — | — |
| Acrolein | — | — | 3 | — |
| Methacrylic acid | 2 | 5 | — | 2 |
| Acrylic acid | — | — | 2 | — |
| 2-Hydroxyethyl methacrylate | — | 5 | — | — |
| 2-Hydroxyethyl acrylate | 6 | — | 3 | 14 |

TABLE 1-continued

| Aqueous dispersions | A-1 | A-2 | A-3 | A-4 |
|---|---|---|---|---|
| | (unit: parts by weight) | | | |
| Styrene | — | 35 | — | |
| Methyl methacrylate | 48 | — | 50 | 48 |
| Butyl acrylate | — | 37 | — | |
| 2-Ethylhexyl methacrylate | 36 | — | 42 | 36 |
| Dodecylmercaptan | 0.3 | 0.5 | 0.2 | 0.3 |
| Dimethylethanolamine | 0.8 | 4 | 2 | 0.8 |
| Triethylamine | 0.8 | 4 | 2 | 0.8 |
| Ethylene glycol monobutyl ether | 15 | 10 | 15 | 15 |
| Weight average molecular weight of copolymer (× 10,000) | 9.8 | 6.4 | 12.5 | 9.0 |
| Solid content in the aqueous dispersion (%) | 38 | 34 | 37 | 38 |

Preparation of resin aqueous dispersion B-1

263 Parts of aqueous dispersion A-1, 240 parts of silica sand having an average particle size of 70 μm, 6 parts of iron oxide pigment and 6.7 parts of a 20% methyl ethyl ketone solution of bisacetyl dihydrazone (hydrazone residues being 0.5 equivalent per equivalent of carbonyl groups of the copolymer in the aqueous dispersion) were thoroughly stirred, mixed and dispersed, and then 16 parts of a thickener was added thereto to obtain resin aqueous dispersion B-1.

Preparation of resin aqueous dispersions B-2 to B-6

Resin aqueous dispersions B-2 to B-6 were prepared in the same manner as for resin aqueous dispersion B-1 except that the components as identified in Table 2 were used.

TABLE 2

| Resin aqueous dispersions | B-1 | B-2 | B-3 | B-4 | B-5 | B-6 |
|---|---|---|---|---|---|---|
| | (unit: parts by weight) | | | | | |
| Aqueous dispersion A-1 | 263 | 263 | — | — | 263 | — |
| Aqueous dispersion A-2 | — | — | 295 | — | — | — |
| Aqueous dispersion A-3 | — | — | — | 268 | — | — |
| Aqueous dispersion A-4 | — | — | — | — | — | 293 |
| 20% Methyl ethyl ketone solution of bisacetyl dihydrazone | 6.7 | — | 9.1 | 15.3 | — | 6.7 |
| 50% Aqueous solution adipic acid dihydrazide | — | 4.1 | — | — | — | — |
| Silica sand | 240 | 240 | 240 | 240 | 240 | 240 |
| Iron oxide pigment | 6 | 6 | 6 | 6 | 6 | 6 |
| Thickener | 16 | 16 | 16 | 16 | 16 | 16 |
| Viscosity (20° C.) | | | | | | |
| BM type viscometer 6 rotations (poise) | 490 | 260 | 330 | 380 | 273 | 340 |
| BM type viscometer 60 rotations (poise) | 81 | 62 | 65 | 70 | 63 | 75 |
| Thixotropic index | 6.0 | 4.2 | 5.1 | 5.4 | 4.3 | 4.5 |
| PVC % of silica sand | 52 | 52 | 52 | 52 | 52 | 52 |
| Equivalents of the hydrazone residues or the hydrazine residues per equivalent of the carbonyl residues of the copolymer | 0.5 | 0.5 | 0.3 | 1.0 | 0.0 | — |
| Solid content (%) | 65.0 | 65.5 | 61.0 | 64.0 | 66.0 | 65.0 |

EXAMPLE 1

The surface of a rusted steel plate of 3.2×70×150 mm was subjected to surface preparation by a disk sander to attain SIS-St3, and on the surface, resin aqueous dispersion B-1 was coated in an amount of 40 g/m$^2$ by an air spray and naturally dried for 2 hours to form a coating having a ten point height of irregularity (Rz) of 90 μm and a ratio of Sm/Rz of 2.2, where Sm is the average spacing of roughness peaks.

Then, on the surface of the steel plate having the coating thus formed as a primer layer, a Zn-Al pseudo alloy was sprayed by a depressurized arc spraying method so that the average coating thickness would be 80 μm. The conditions for the Zn-Al pseudo alloy spraying were such that using one pure zinc wire having a diameter of 1.3 mm and one pure aluminum wire having a diameter of 1.3 mm, the spraying was carried out at a wire feeding speed of 5 m/min at a voltage of 15 V at an electric current of 130 A under an air pressure of 6 kg/cm$^2$ by means of an arc spraying machine PA100 manufactured by Pan Art Craft Co., Ltd.

The obtained metal-sprayed test plate was subjected to evaluation of the adhesion, solvent resistance, heat resistance and corrosion resistance, and the results are shown in Table 3. Further, the results of evaluation of the storage stability of resin aqueous dispersion B-1 of one pack cold self-crosslinking type are also shown in Table 3.

EXAMPLE 2

A metal-sprayed test plate was prepared in the same manner as in Example 1 except that instead of resin aqueous dispersion B-1, resin aqueous dispersion B-2 (as identified in Table 2) was used, and a coating as a primer layer having Rz of 80 μm and a ratio of Sm/Rz of 2.4, was formed.

Evaluation of the obtained metal-sprayed test plate and evaluation of resin aqueous dispersion B-2 of one pack cold self-crosslinking type were carried out in the same manner as in Example 1, and the results are shown in Table 3.

EXAMPLE 3

A metal-sprayed test plate was prepared in the same manner as in Example 1 except that instead of resin aqueous dispersion B-1, resin aqueous dispersion B-3 (as identified in Table 2) was used, and a coating as a primer layer having Rz of 70 μm and a ratio of Sm/Rz of 2.9, was formed.

Evaluation of the obtained metal-sprayed test plate and evaluation of resin aqueous dispersion B-3 of one pack cold self-crosslinking type were carried out in the same manner as in Example 1, and the results are shown in Table 3.

EXAMPLE 4

A metal-sprayed test plate was prepared in the same manner as in Example 1 except that instead of resin aqueous dispersion B-1, resin aqueous dispersion B-4 (as identified in Table 2) was used, and a coating as a primer layer having Rz of 75 μm and a ratio of Sm/Rz of 2.8, was formed.

Evaluation of the obtained metal-sprayed test plate and evaluation of resin aqueous dispersion B-4 of one pack cold self-crosslinking type were carried out in the same manner as in Example 1, and the results are shown in Table 3.

COMPARATIVE EXAMPLE 1

A metal-sprayed test plate was prepared in the same manner as in Example 1 except that instead of resin aqueous dispersion B-1, resin aqueous dispersion B-5 (as identified in Table 2) was used, and a coating as a primer layer having Rz of 80 μm and a ratio of Sm/Rz of 2.7, was formed.

Evaluation of the obtained metal-sprayed test plate and evaluation of resin aqueous dispersion B-5 of one pack cold non-crosslinking type were carried out in the same manner as in Example 1, and the results are shown in Table 3.

COMPARATIVE EXAMPLE 2

A metal-sprayed test plate was prepared in the same manner as in Example 1 except that instead of resin aqueous dispersion B-1, resin aqueous dispersion B-6 (as identified in Table 2) was used, and a coating as a primer layer having Rz of 90 μm and a ratio of Sm/Rz of 2.3, was formed.

Evaluation of the obtained metal-sprayed test plate and evaluation of resin aqueous dispersion B-6 of one pack cold non-crosslinking type were carried out in the same manner as in Example 1, and the results are shown in Table 3.

TABLE 3

| | Example | | | | Comparative Example | |
|---|---|---|---|---|---|---|
| | 1 | 2 | 3 | 4 | 1 | 2 |
| Adhesion (kgf/cm$^2$) *1) | 80 | 75 | 80 | 75 | 70 | 75 |
| Solvent resistance *2) | Normal | Normal | Normal | Normal | Coating peeled | Coating peeled |
| Heat resistance *3) | Normal | Normal | Normal | Normal | Coating peeled | Coating peeled |
| Corrosion resistance *4) | | | | | | |
| 2000 hrs | Excellent with dense white rust | Excellent with dense white rust | Excellent with dense white rust | Excellent with dense white rust | Lifting observed over about 40% of the coating | Lifting observed over about 35% of the coating |
| 3000 hrs | Normal with dense white rust | Lifting observed over about 10% of the coating | Normal with dense white rust | Normal with dense white rust | Lifting observed over about 80% of the coating | Lifting observed over about 70% of the coating |
| Storage stability *5) | Normal | Normal | Normal | Normal | Normal | Normal |

*1) To the metal-sprayed test plate, additional spraying was further carried out in a thickness of 300 μm. Then, an aluminum jig of 20 mm in diameter was bonded by an epoxy resin adhesive to the metal spray coating and the rear side of the substrate, and the coating around the jig was removed. Then, the vertical tensile strength was measured in accordance with ASTM C633 by pulling at a rate of 1 mm/min.
*2) The metal-sprayed test plate was immersed in a xylene solution for 2 hours, whereby the solvent resistance was visually inspected.
*3) The metal-sprayed test plate was left to stand for 2 hours in a dry furnace at 150° C., whereby the heat resistance was visually inspected.
*4) The metal-sprayed test plate was immersed in water for 4 days, whereupon it was subjected to a salt spray test for 2000 hours and 3000 hours, whereby the corrosion resistance was visually inspected.
*5) The resin aqueous dispersion was left to stand for 20 days at a temperature of 50° C., whereby the presence or absence of an abnormality such as gelation was visually inspected.

As is evident from Table 3, in Examples 1 to 4 representing the method of the present invention, the test plates had excellent adhesion, solvent resistance, heat resistance and corrosion resistance. Whereas, in Comparative Example 1 and 2 wherein a one pack type cold non-crosslinking resin aqueous dispersion was used as the primer, the products were inferior in the solvent resistance, heat resistance and corrosion resistance.

What is claimed is:

1. A method for forming a metal spray coating, which comprises coating on a substrate to be metal-sprayed, a one pack cold self-crosslinking resin aqueous dispersion containing insoluble solid particles having an average particle size of from 5 to 200 μm, to form a primer layer having a rough surface, and then spraying a metal on the primer layer, wherein said insoluble solid particles are present in an amount of from 25 to 400 vol %, based on the solid content of said resin aqueous dispersion, and said resin aqueous dispersion is prepared by mixing an aqueous dispersion of a copolymer (A) containing carbonyl groups, other than carbonyl groups based on carboxyl groups or carboxylic acid ester groups, and a hydrazone or hydrazine compound (B) containing at least two hydrazone or hydrazine residues in its molecule, in such a ratio that the hydrazone or hydrazine residues of the hydrazone or hydrazine compound (B) are from 0.1 to 2 equivalents per equivalent of the carbonyl groups of the copolymer (A).

2. The method for forming a metal spray coating according to claim 1, wherein the resin aqueous dispersion is a dispersion containing the insoluble solid particles having an average particle size of from 5 to 200 μm in an amount of from 25 to 400 vol %, based on the solid content of said resin aqueous dispersion prepared by mixing an aqueous dispersion of a copolymer (A) containing carbonyl groups, other than carbonyl groups based on carboxyl groups or carboxylic acid ester groups, and a hydrazone compound (B) containing at least two hydrazone residues in its molecule, in such a ratio that the hydrazone residues of the hydrazone compound (B) are from 0.1 to 2 equivalents per equivalent of the carbonyl groups of the copolymer (A).

3. The method for forming a metal spray coating according to claim 2, wherein the primer layer has a rough surface represented by Rz being from 10 to 250 μm and a ratio of Sm/Rz being at most 5, where Rz is the ten point height of irregularity and Sm is the average spacing of roughness peaks.

4. The method of claim 2, wherein said copolymer (A) has a solid content of from 20–50 wt. %.

5. The method of claim 2, wherein said ratio of copolymer (A) and hydrazone compound (B) is such that the hydrazone residues of the hydrazone compound (B) are present in from 0.3 to 1.2 equivalents per equivalent of the carbonyl groups of the copolymer (A).

6. The method for forming a metal spray coating according to claim 1, wherein the resin aqueous dispersion is a dispersion containing the insoluble solid particles having an average particle size of from 5 to 200 μm in an amount of from 25 to 400 vol %, based on the solid content of said resin aqueous dispersion prepared by mixing an aqueous dispersion of a copolymer (A) containing carbonyl groups, other than carbonyl groups based on carboxyl groups or carboxylic acid ester groups, and a hydrazine compound (B') containing at least two hydrazine residues in its molecule, in such a ratio that the hydrazine residues of the hydrazine compound (B') are from 0.1 to 2 equivalents per equivalent of the carbonyl groups of the copolymer (A).

7. The method for forming a metal spray coating according to claim 6, wherein the primer layer has a rough surface represented by Rz being from 10 to 250 μm and a ratio of Sm/Rz being at most 5, where Rz is the ten point height of irregularity and Sm is the average spacing of roughness peaks.

8. The method of claim 6, wherein said copolymer (A) has a solid content of from 20–50 wt. %.

9. The method of claim 6, wherein said ratio of copolymer (A) and hydrazine compound (B') is such that the hydrazine residues of the hydrazine compound (B') are present in from 0.3 to 1.2 equivalents per equivalent of the carbonyl groups of the copolymer (A).

10. The method for forming a metal spray coating according to claim 1, wherein the primer layer has a rough surface represented by Rz being from 10 to 250 μm and a ratio of Sm/Rz being at most 5, where Rz is the ten point height of irregularity and Sm is the average spacing of roughness peaks.

* * * * *